US008381871B1

(12) United States Patent
Hellie et al.

(10) Patent No.: US 8,381,871 B1
(45) Date of Patent: Feb. 26, 2013

(54) COMPACT LOW FREQUENCY RESONATOR

(75) Inventors: Mark Donald Hellie, Westland, MI (US); Anthony C. Arruda, Ann Arbor, MI (US); Christopher Edward Shaw, Canton, MI (US); Joshua Sparks, Southgate, MI (US)

(73) Assignee: Visteon Global Technologies, Inc., Van Buren Township, MI (US)

( * ) Notice: Subject to any disclaimer, the term of this patent is extended or adjusted under 35 U.S.C. 154(b) by 0 days.

(21) Appl. No.: 13/246,931

(22) Filed: Sep. 28, 2011

(51) Int. Cl.

| | |
|---|---|
| ***F01N 1/02*** | (2006.01) |
| ***F01N 1/08*** | (2006.01) |
| ***F01N 1/16*** | (2006.01) |
| ***F01N 13/08*** | (2010.01) |
| ***F02M 35/00*** | (2006.01) |
| ***F02M 35/10*** | (2006.01) |
| ***E04F 17/04*** | (2006.01) |

(52) U.S. Cl. ..... 181/250; 123/184.53; 123/184.57; 181/224; 181/227; 181/229; 181/271; 181/273; 181/276

(58) Field of Classification Search ..... 181/250, 181/224, 273, 276; 123/184.57, 184.53
See application file for complete search history.

(56) References Cited

U.S. PATENT DOCUMENTS

| | | | | |
|---|---|---|---|---|
| 2,483,768 | A * | 10/1949 | Hershberger | 455/39 |
| 4,294,330 | A * | 10/1981 | Baldwin et al. | 181/230 |
| 4,539,947 | A * | 9/1985 | Sawada et al. | 123/184.57 |
| 5,349,141 | A * | 9/1994 | Horibe et al. | 181/224 |
| 6,581,722 | B2 * | 6/2003 | Faulhaber et al. | 181/250 |
| 6,792,907 | B1 * | 9/2004 | Kostun et al. | 123/184.57 |
| 6,932,189 | B2 * | 8/2005 | Helber et al. | 181/240 |
| 7,080,514 | B2 * | 7/2006 | Bland et al. | 60/725 |
| 7,111,601 | B2 | 9/2006 | Moenssen et al. | |
| 7,255,197 | B2 * | 8/2007 | Horiko | 181/250 |
| 7,350,496 | B2 * | 4/2008 | Nakayama et al. | 123/184.57 |
| 7,448,353 | B2 * | 11/2008 | Shinada et al. | 123/184.57 |
| 7,451,733 | B2 * | 11/2008 | Kwack | 123/184.57 |
| 7,530,341 | B2 | 5/2009 | Carpenter | |
| 7,540,353 | B2 * | 6/2009 | Okawa et al. | 181/250 |
| 7,845,466 | B2 * | 12/2010 | Kostun et al. | 181/271 |
| 2002/0157897 | A1 * | 10/2002 | Hofmann et al. | 181/214 |
| 2007/0044747 | A1 * | 3/2007 | Sawatari et al. | 123/184.21 |
| 2007/0163533 | A1 * | 7/2007 | Nakayama et al. | 123/184.57 |
| 2009/0000587 | A1 * | 1/2009 | Seko et al. | 123/184.57 |
| 2009/0057054 | A1 * | 3/2009 | Kostun et al. | 181/206 |
| 2010/0212999 | A1 * | 8/2010 | Marion et al. | 181/250 |
| 2011/0061970 | A1 * | 3/2011 | Caliskan | 181/276 |

FOREIGN PATENT DOCUMENTS

| | | |
|---|---|---|
| JP | 58124057 | 7/1983 |
| JP | 58124057 A * | 7/1983 |

OTHER PUBLICATIONS

The Engineering Toolbox, Elastic Properties and Young Modulus for some Materials, accessed Aug. 19, 2012, http://www.engineeringtoolbox.com/young-modulus-d_417.html.*

* cited by examiner

*Primary Examiner* — David Warren
*Assistant Examiner* — Christina Russell
(74) *Attorney, Agent, or Firm* — Fraser Clemens Martin & Miller LLC; J. Douglas Miller

(57) ABSTRACT

A resonator for a vehicle is provided, including a housing having at least one chamber formed therein. The housing has at least one aperture formed in a wall thereof. The housing is in fluid communication with an air conduit of the vehicle. At least one flexible member is disposed within the chamber of the housing. The flexible member includes an outer portion and an inner extension protruding from the outer portion which vibrates to attenuate low frequency sound energy transmitted from the air conduit.

19 Claims, 4 Drawing Sheets

COMPACT LOW FREQUENCY RESONATOR

FIELD OF THE INVENTION

The present invention relates generally to a resonator for an air flow system and, more particularly, to a compact low frequency resonator for an air flow system of a vehicle.

BACKGROUND OF THE INVENTION

An internal combustion engine in a vehicle typically is in fluid communication with an air induction system and an air exhaust system for providing air to the engine, and exhausting air from the engine, respectively. In the internal combustion engine, sound energy is often generated in the form of acoustic pressure waves as air flows through the air induction and exhaust systems. In particular, vibrations are often caused by intake air flowing through an air feed conduit of the air induction system. Specifically, vibrations are caused by the induction of air into a cylinder of the internal combustion engine by a cyclic movement of a piston slidably disposed in the cylinder.

Generally, resonators are employed to reduce engine intake noise and improve noise comfort in the vehicle interior. Resonators operate by reflecting sound waves generated by the engine 180 degrees out of phase. The combination of the sound waves generated by the engine with the out of phase sound waves results in a reduction or cancellation of the amplitude of the sound waves. The air induction system in a four-cylinder vehicle, for example, typically requires a low frequency resonator (i.e. less than 250 hertz) or a quarter-wave resonator to attenuate the sound energy. Presently known low frequency and quarter-wave resonators, however, are required to be large in size in order to operate as desired. For example, a Helmholtz resonator may require a package volume of 6.0 liters and a quarter-wave resonator may have a length of 1.5 meters. In turn, such resonators are difficult to package and require complex routing to properly mount in an engine compartment. Additionally, manufacturing such large resonators requires expensive molding presses or additional processes for welding together multiple components of the resonators.

It would be desirable to produce a resonator which is readily configurable to attenuate low frequencies, wherein a structural complexity and a package size thereof are minimized.

SUMMARY OF THE INVENTION

In concordance and agreement with the present disclosure, a resonator which is readily configurable to attenuate low frequencies, wherein a structural complexity and a package size thereof are minimized, has surprisingly been discovered.

In one embodiment, the resonator for a vehicle, comprises: a housing including at least one chamber formed therein, wherein the housing is coupled to and in fluid communication with an air conduit; and at least one flexible member disposed within the at least one chamber to attenuate sound energy, wherein the flexible member includes an outer portion having an extension protruding therefrom into the housing.

In another embodiment, the resonator for a vehicle, comprises: a housing including a plurality of chambers and at least one aperture formed therein, wherein the housing is coupled to and in fluid communication with an air conduit through at least one connector conduit; and a flexible member disposed within each of the chambers to attenuate sound energy, wherein the flexible member includes an outer portion having an extension protruding therefrom into the housing.

In a further embodiment, the resonator for a vehicle, comprises: a housing including a chamber and at least one aperture formed therein, wherein the housing is coupled to and in fluid communication with an air conduit through at least one connector conduit; and a plurality of flexible members disposed within the chamber to attenuate sound energy, wherein the flexible member includes an outer portion having an extension protruding therefrom into the housing.

BRIEF DESCRIPTION OF THE DRAWINGS

The above, as well as other objects and advantages of the invention, will become readily apparent to those skilled in the art from a reading the following detailed description of the invention when considered in the light of the accompanying drawings in which.

DETAILED DESCRIPTION OF THE INVENTION

The following detailed description and appended drawings describe and illustrate various exemplary embodiments of the invention. The description and drawings serve to enable one skilled in the art to make and use the invention, and are not intended to limit the scope of the invention in any manner.

Figure 1:
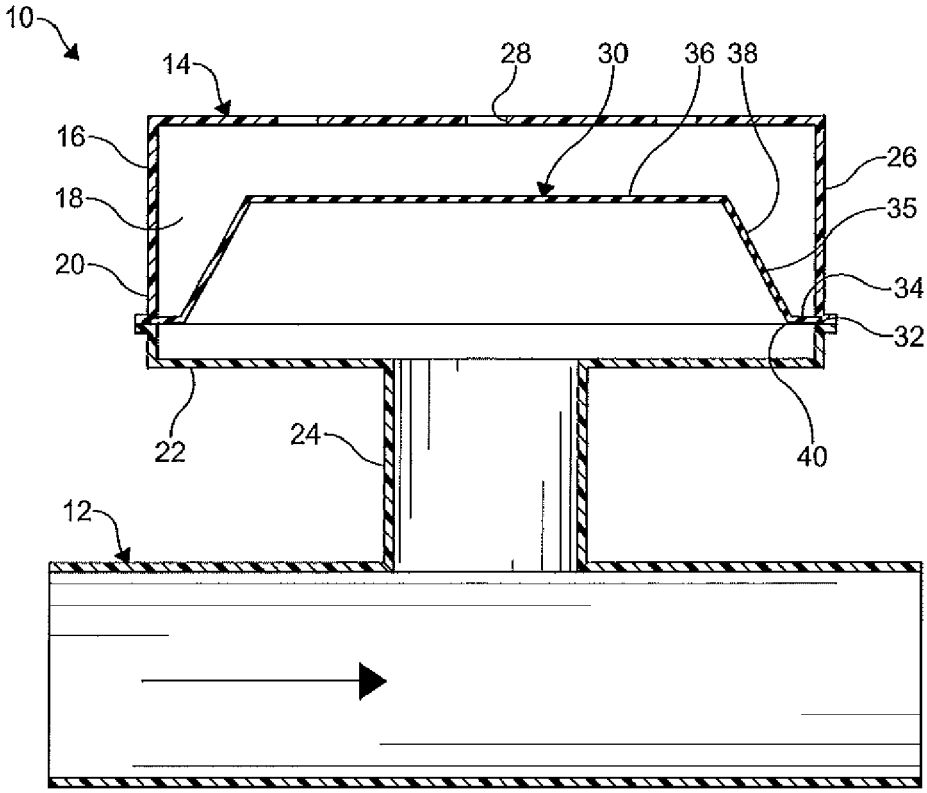
FIG. 1 is a cross-sectional elevational view of a resonator including a housing having a flexible member disposed therein according to an embodiment of the present invention.

FIG. 1 shows a portion of an air flow system 10 according to an embodiment of the present invention. The air flow system 10 includes an air conduit 12 and a resonator 14. A first end of the air conduit is in fluid communication with an internal combustion engine (not shown) which is adapted to be disposed in an engine compartment of a motor vehicle. The air conduit 12 is in fluid communication with at least one of an air induction system and an air exhaust system. An air stream flows through the air conduit 12 as indicated by the directional arrow of FIG. 1 to the internal combustion engine. As is known in the art, the air induction system is typically adapted to deliver a stream of substantially clean air to the internal combustion engine. The air exhaust system, also as is known in the art, is adapted to direct a stream of exhausted air away from the internal combustion engine and to a vehicle exhaust system.

In particular embodiments, the air conduit 12 is an inlet air duct, such as a charge duct for a turbo or supercharged engine, or a clean air duct for a normally-aspirated engine, in fluid communication with the air induction system. As a non-limiting example, the air conduit 12 may be disposed between an air filter and a throttle body of the air induction system. In other embodiments, the air conduit 12 is an exhaust air duct in fluid communication with the air exhaust system.

As illustrated, the resonator 14 is in fluid communication with the air conduit 12. The resonator 14 is configured to attenuate acoustic pressure waves or "noise" from the air conduit 12. The resonator 14 is intended to replace large volume resonators (i.e. greater than 3.0 liters), which are typically required for tuning frequencies below 250 hertz. The resonator 14 shown in FIG. 1 can be used to attenuate high frequency sound energy and low frequency sound energy. The resonator 14 includes a housing 16 having a chamber 18 formed therein which is defined, at least in part, by a wall 20 of the housing 16. The housing 16 and the chamber 18 can have any suitable shape as desired such as a generally circular cross-sectional shape or a generally rectangular cross-sectional shape, for example. A skilled artisan should understand that the housing 16 may be formed from any suitable material as desired. For example, suitable materials may include at least one of a thermoplastic, a thermoset, a metal, and a composite material. In particular embodiments, the housing 16 may be formed by one of an injection molding and a blow molding process with a thermoplastic or a thermoset material. One of ordinary skill in the art should also appreciate that suitable dimensions of the chamber 18 may be selected, for example, to attenuate a desired amount of the acoustic pressure waves. In a non-limiting example, the chamber 18 has a volume less than 0.5 liters, and as small as 0.2 liters.

A first portion 22 of the housing 16 includes a connector conduit 24. The connector conduit 24 is coupled to the air conduit 12, and provides fluid communication between the air conduit 12 and the resonator 14. In an illustrative embodiment, the connector conduit 12 is of a lesser volume than a volume of the chamber 18 of the resonator 14. The connector conduit 12 may be adapted to control the acoustic pressure waves transmitted from the air conduit 12 to the chamber 18. A suitable connector conduit 12 size may be selected as desired. In particular embodiments, the connector conduit 12 and the housing 16 of the resonator 14 are sized to attenuate the high frequency sound energy. A second portion 26 of the housing 16 includes a plurality of apertures 28 formed therein to provide communication between the chamber 18 and the atmosphere. The apertures 28 are sized to minimize an amount of sound energy emanating from the resonator 14. It is understood, however, that the apertures 28 can also be sized and oriented to adjust at least one of a volume level, a direction, and a frequency of the sound energy emanating from the resonator 14.

The resonator 14 further includes a flexible member 30 disposed therein. As shown in FIG. 1, an outer peripheral edge 32 of the flexible member 30 is crimped between the portions 22, 26 of the housing 16 to secure the flexible member 30 in the chamber 18. The apertures 28 formed in the housing 16 permit the flexible member 30 to vibrate in response to the acoustic pressure waves routed from the air conduit 12 to the chamber 18, and thereby attenuate the low frequency sound energy. It is understood that the flexible member 30 can be tuned to attenuate a desired frequency range. The flexible member 30 is formed from a material suitable for attenuating sound energy. Suitable materials may include, for example, at least one of a metal, a polymer, an elastomer, and a composite material. Illustratively, the flexible member 30 is a rubber or composite diaphragm, for example. A skilled artisan should appreciate that suitable materials and dimensions may be selected to attenuate the desired frequency. The suitable materials and dimensions may also provide a flexible member 30 that is substantially insensitive to temperature and humidity changes, which typically occur during vehicle operation. It should be understood that the flexible member 30 may be removable. Being removable, different flexible members 30 may be employed as desired to provide selective tuning of the resonator 14. Alternatively, the flexible member 30 may be permanently coupled to the housing 16, such as by securing the flexible member 30 to the wall 20 using an adhesive, for example.

The flexible member 30 shown lies in a plane transverse to a longitudinal axis of the connector conduit 12. The flexible member 30 shown includes an outer portion 34 and an inner extension 35 protruding from the outer portion 34 inwardly into the housing 16 away from the connector conduit 12. The extension 35 shown is generally frusto-conical shaped having a generally planar portion 36 and an inwardly angled annular portion 38 extending between the outer portion 34 and the planar portion 36. The annular portion 38 structurally supports the planar portion 36 so that the flexible member 30 retains its shape. Retention of the shape of the flexible member 30 provides consistent attenuation of the sound energy at the desired frequency during operation of the vehicle. As shown, the planar portion 36 has a smaller diameter than a diameter of the outer portion 34. It is understood that the planar portion 36 may include at least one aperture (not shown) formed therein if desired. The outer portion 34 is supported by the housing 16 in such manner that a radially inner region 40 of the outer portion 34 and the extension 35 are capable of flexing in response to the acoustic pressure waves from the connector conduit 12. Although the outer portion 34 and the extension 35 of the flexible member 30 shown have a generally circular shape, it is understood that each of the outer portion 34 and the extension 35 can have any suitable shape as desired such as a square or rectangular shape, for example. It is further understood that the flexible member 30 can have any suitable shape as desired.

Figure 2:
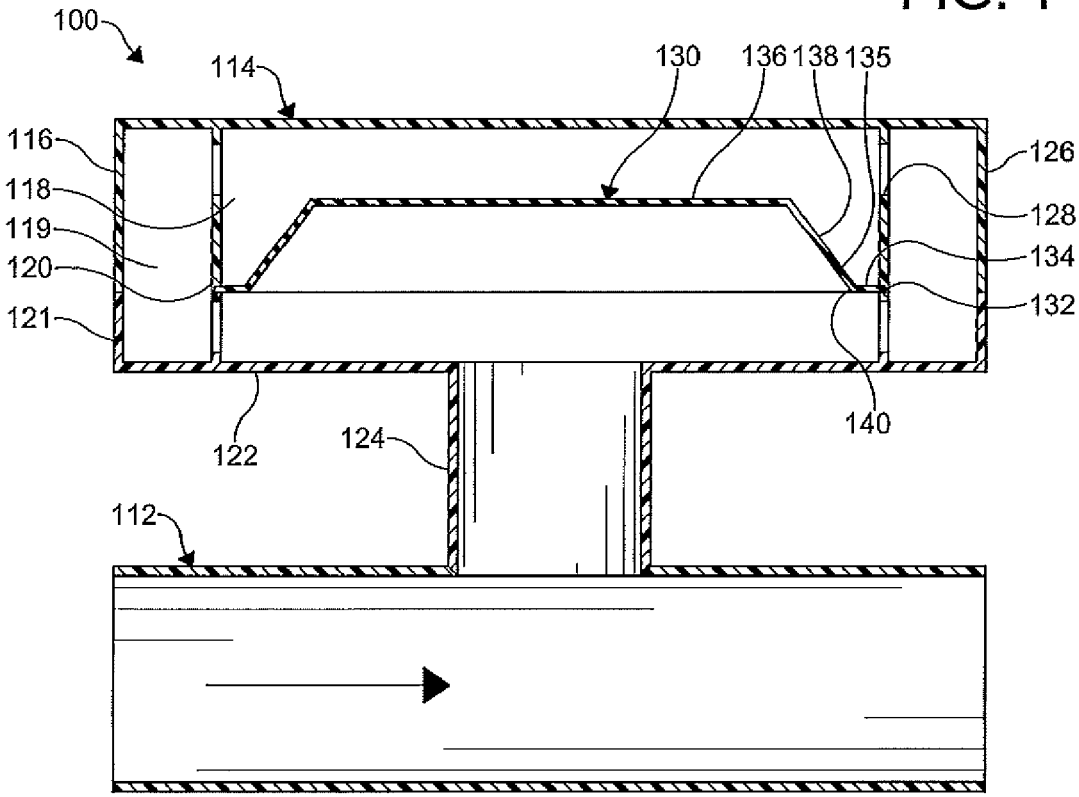
FIG. 2 is a cross-sectional elevational view of a resonator including a housing having a flexible member disposed therein according to another embodiment of the present invention, wherein a plurality of apertures are formed in an interior wall of the housing.

FIG. 2 shows a portion of an air flow system 100 according to an embodiment of the present invention. The resonator 114 shown includes a housing 116 having an inner first chamber 118 and an outer second chamber 119 formed therein. The first chamber 118 is defined, at least in part, by an interior wall 120 of the housing 116. The second chamber 119 is defined, at least in part, by an exterior wall 121. The interior wall 120 of the housing 116 includes a plurality of apertures 128 formed therein to provide communication between the chambers 118, 119. The apertures 128 are sized to minimize an amount of sound energy emanating from the resonator 114. It is understood, however, that the apertures 128 can also be sized and oriented to adjust at least one of a volume level, a direction, and a frequency of the sound energy emanating from the resonator 114. The housing 116 and the chambers 118, 119 can have any suitable shape as desired such as a generally circular cross-sectional shape or a generally rectangular cross-sectional shape, for example. A skilled artisan should understand that the housing 116 may be formed from any suitable material as desired. For example, suitable materials may include at least one of a thermoplastic, a thermoset, a metal, and a composite material. In particular embodiments, the housing 116 may be formed by one of an injection molding and a blow molding process with a thermoplastic or a thermoset material. One of ordinary skill in the art should also appreciate that suitable dimensions of the chamber 118 may be selected, for example, to attenuate a desired amount of the acoustic pressure waves. In a non-limiting example, the chamber 118 has a volume less than 0.5 liters, and as small as 0.2 liters.

A first portion 122 of the housing 116 includes a connector conduit 124. The connector conduit 124 is coupled to the air conduit 112, and provides fluid communication between the air conduit 112 and the resonator 114. In an illustrative embodiment, the connector conduit 124 is of a lesser volume than a volume of the chamber 118 of the resonator 114. The connector conduit 124 may be adapted to control the acoustic pressure waves transmitted from the air conduit 112 to the chamber 118. A suitable connector conduit 124 size may be selected as desired. In particular embodiments, the connector conduit 124 and the housing 116 of the resonator 114 are sized to attenuate the high frequency sound energy.

The resonator 114 further includes a flexible member 130 disposed therein. As shown in FIG. 2, an outer peripheral edge 132 of the flexible member 130 is crimped between the portions 122, 126 of the housing 116 to secure the flexible member 130 in the chamber 118. The apertures 128 formed in the interior wall 120 of the housing 116 allow air to flow around the flexible member 130 to equalize pressure in the chambers 118, 119. Accordingly, the flexible member 130 is permitted to vibrate in response to the acoustic pressure waves routed from the air conduit 112 to the chamber 118, and thereby attenuate the low frequency sound energy. It is understood that the flexible member 130 can be tuned to attenuate a desired frequency range. The flexible member 130 is formed from a material suitable for attenuating sound energy. Suitable materials may include, for example, at least one of a metal, an elastomer, a polymer, and a composite material. Illustratively, the flexible member 130 is a rubber or composite diaphragm, for example. A skilled artisan should appreciate that suitable materials and dimensions may be selected to attenuate the desired frequency. The suitable materials and dimensions may also provide a flexible member 130 that is substantially insensitive to temperature and humidity changes, which typically occur during vehicle operation. It should be understood that the flexible member 130 may be removable. Being removable, different flexible members 130 may be employed as desired to provide selective tuning of the resonator 114. Alternatively, the flexible member 130 may be permanently coupled to the housing 116, such as by securing the flexible member 130 to the wall 120 using an adhesive, for example.

The flexible member 130 shown lies in a plane transverse to a longitudinal axis of the connector conduit 124. The flexible member 130 shown includes an outer portion 134 and an inner extension 135 protruding from the outer portion 134 inwardly into the housing 116 away from the connector conduit 124. The extension 135 shown is generally frusto-conical shaped having a generally planar portion 136 and an inwardly angled annular portion 138 extending between the outer portion 134 and the planar portion 136. The annular portion 138 structurally supports the planar portion 136 so that the flexible member 130 retains its shape. Retention of the shape of the flexible member 130 provides consistent attenuation of the sound energy at the desired frequency during operation of the vehicle. As shown, the planar portion 136 has a smaller diameter than a diameter of the outer portion 134. It is understood that the planar portion 136 may include at least one aperture (not shown) formed therein if desired. The outer portion 134 is supported by the housing 116 in such manner that a radially inner region 140 of the outer portion 134 and the extension 135 are capable of flexing in response to the acoustic pressure waves from the connector conduit 124. Although the outer portion 134 and the extension 135 of the flexible member 130 shown have a generally circular shape, it is understood that each of the outer portion 134 and the extension 135 can have any suitable shape as desired such as a square or rectangular shape, for example. It is further understood that the flexible member 130 can have any suitable shape as desired.

Figure 3:
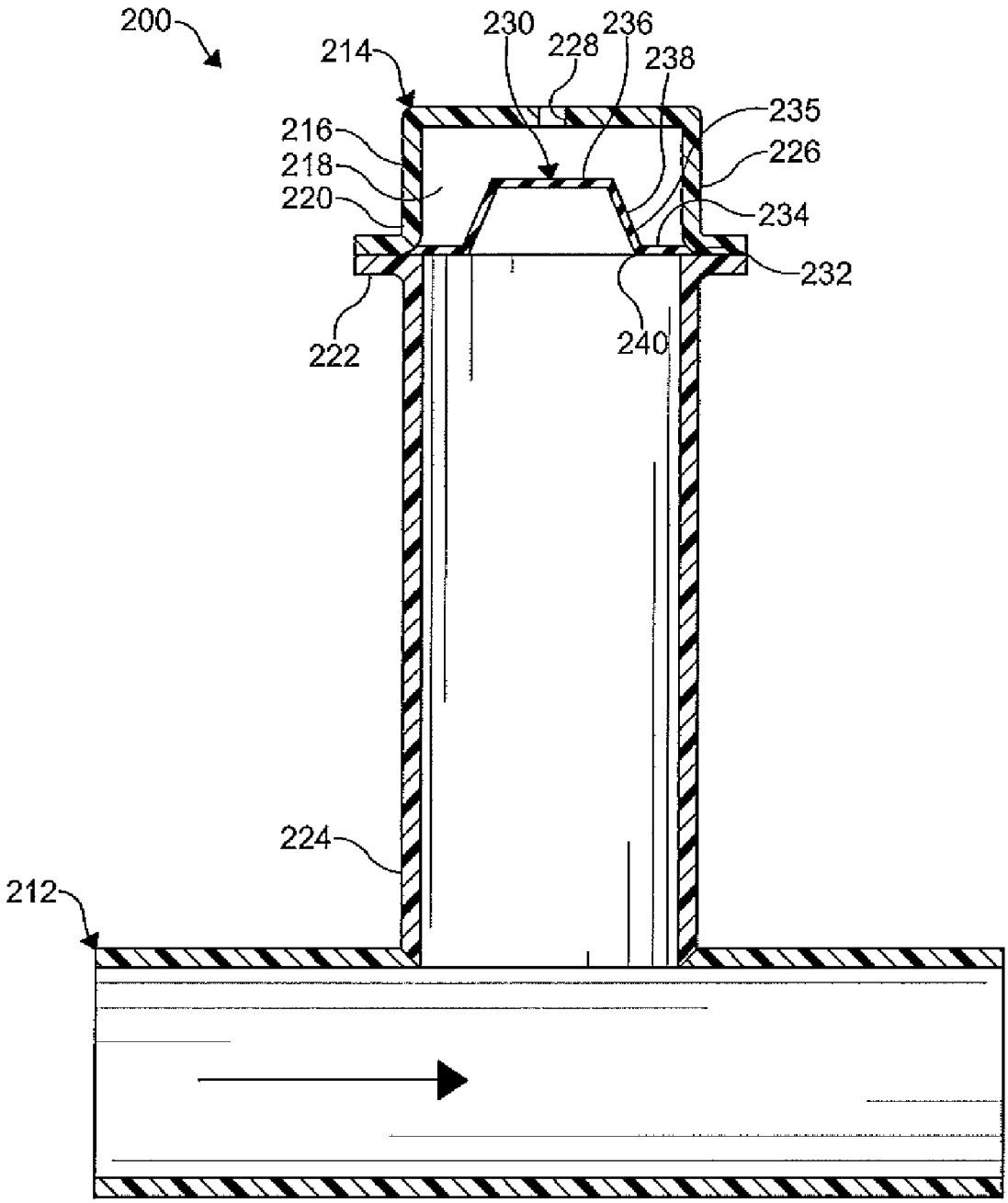
FIG. 3 is a cross-sectional elevational view of a resonator including a housing having a flexible member disposed therein according to another embodiment of the present invention, wherein a diameter of a connector conduit of a first portion of the housing and a diameter of a second portion of the housing are substantially identical.

FIG. 3 shows a portion of an air flow system 200 according to an embodiment of the present invention. The resonator 214 includes a housing 216 having a chamber 218 formed therein which is defined, at least in part, by a wall 220 of the housing 216. The housing 216 and the chamber 218 can have any suitable shape as desired such as a generally circular cross-sectional shape or a generally rectangular cross-sectional shape, for example. A skilled artisan should understand that the housing 216 may be formed from any suitable material as desired. For example, suitable materials may include at least one of a thermoplastic, a thermoset, a metal, and a composite material. In particular embodiments, the housing 216 may be formed by one of an injection molding and a blow molding process with a thermoplastic or a thermoset material. One of ordinary skill in the art should also appreciate that suitable dimensions of the chamber 218 may be selected, for example, to attenuate a desired amount of the acoustic pressure waves. In a non-limiting example, the chamber 218 has a volume less than 0.5 liters, and as small as 0.2 liters.

A first portion 222 of the housing 216 includes a connector conduit 224. The connector conduit 214 is coupled to the air conduit 212, and provides fluid communication between the air conduit 212 and the resonator 214. In an illustrative embodiment, a diameter of the connector conduit 224 and a diameter of the chamber 218 of the resonator 214 are substantially identical. The connector conduit 224 may be adapted to control the acoustic pressure waves transmitted from the air conduit 212 to the chamber 218. A suitable connector conduit 224 size may be selected as desired. In particular embodiments, the connector conduit 224 and the housing 216 of the resonator 214 are sized to attenuate the high frequency sound energy. A second portion 226 of the housing 216 includes an aperture 228 formed therein to provide communication between the chamber 218 and the atmosphere. The aperture 228 is sized to minimize an amount of sound energy emanating from the resonator 214. It is understood, however, that the aperture 228 can also be sized and oriented to adjust at least one of a volume level, a direction, and a frequency of the sound energy emanating from the resonator 214.

The resonator 214 further includes a flexible member 230 disposed therein. As shown in FIG. 3, an outer peripheral edge 232 of the flexible member 230 is crimped between the portions 222, 226 of the housing 216 to secure the flexible member 230 in the chamber 218. The aperture 228 formed in the housing 216 permits the flexible member 230 to vibrate in response to the acoustic pressure waves routed from the air conduit 212 to the chamber 218, and thereby attenuate the low frequency sound energy. It is understood that the flexible member 230 can be tuned to attenuate a desired frequency range. The flexible member 230 is formed from a material suitable for attenuating sound energy. Suitable materials include, for example, at least one of a metal, an elastomer, a polymer, and a composite material. Illustratively, the flexible member 230 is a rubber or composite diaphragm, for example. A skilled artisan should appreciate that suitable materials and dimensions may be selected to attenuate the desired frequency. The suitable materials and dimensions may also provide a flexible member 230 that is substantially insensitive to temperature and humidity changes, which typically occur during vehicle operation. It should be understood that the flexible member 230 may be removable. Being removable, different flexible members 230 may be employed as desired to provide selective tuning of the resonator 214. Alternatively, the flexible member 230 may be permanently coupled to the housing 216, such as by securing the flexible member 230 to the wall 220 using an adhesive, for example.

The flexible member 230 shown lies in a plane transverse to a longitudinal axis of the connector conduit 224. The flexible member 230 shown includes an outer portion 234 and an inner extension 235 protruding from the outer portion 234 inwardly into the housing 216 away from the connector conduit 224. The extension 235 shown is generally frusto-conical shaped having a generally planar portion 236 and an inwardly angled annular portion 238 extending between the outer portion 234 and the planar portion 236. The annular portion 238 structurally supports the planar portion 236 so that the flexible member 230 retains its shape. Retention of the shape of the flexible member 230 provides consistent attenuation of the sound energy at the desired frequency during operation of the vehicle. As shown, the planar portion 236 has a smaller diameter than a diameter of the outer portion 234. It is understood that the planar portion 236 may include at least one aperture (not shown) formed therein if desired. The outer portion 234 is supported by the housing 216 in such manner that a radially inner region 240 of the outer portion 234 and the extension 235 are capable of flexing in response to the acoustic pressure waves from the connector conduit 224. Although the outer portion 234 and the extension 235 of the flexible member 230 shown have a generally circular shape, it is understood that each of the outer portion 234 and the extension 235 can have any suitable shape as desired such as a square or rectangular shape, for example. It is further understood that the flexible member 230 can have any suitable shape as desired.

Figure 4:
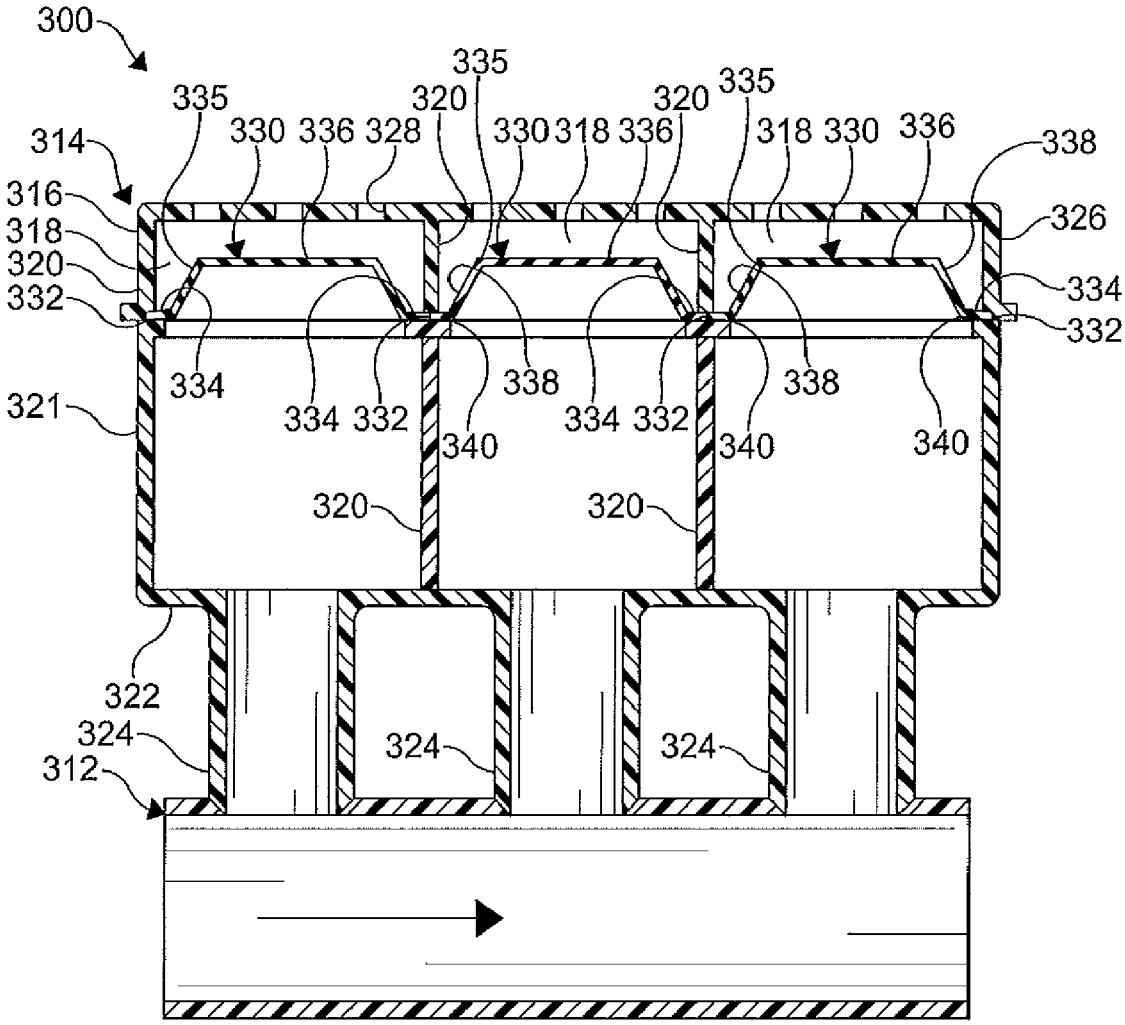
FIG. 4 is a cross-sectional elevational view of a resonator including a housing having a plurality of chambers formed therein and a plurality of flexible members disposed therein according to another embodiment of the present invention.

FIG. 4 shows a portion of an air flow system 300 according to an embodiment of the present invention. The resonator 314 includes a housing 316 having a plurality of chambers 318 formed therein which are defined, at least in part, by a plurality of interior walls 320 and an exterior wall 321 of the housing 316. The housing 316 and the chambers 318 can have any suitable shape as desired such as a generally circular cross-sectional shape or a generally rectangular cross-sectional shape, for example. A skilled artisan should understand that the housing 316 may be formed from any suitable material as desired. For example, suitable materials may include at least one of a thermoplastic, a thermoset, a metal, and a composite material. In particular embodiments, the housing 316 may be formed by one of an injection molding and a blow molding process with a thermoplastic or a thermoset material. One of ordinary skill in the art should also appreciate that suitable dimensions of the chambers 318 may be selected, for example, to attenuate a desired amount of the acoustic pressure waves. In a non-limiting example, each of the chambers 318 has a volume less than 0.5 liters, and as small as 0.2 liters.

A first portion 322 of the housing 316 includes a plurality of connector conduits 324. The connector conduits 324 are coupled to the air conduit 312, and provide fluid communication between the air conduit 312 and the chambers 318 of the resonator 314. In an illustrative embodiment, each of the connector conduits 324 is of a lesser volume than a volume of the respective chamber 318 of the resonator 314. The connector conduits 324 may be adapted to control the acoustic pressure waves transmitted from the air conduit 312 to the chambers 318. A suitable connector conduit 324 size may be selected as desired. In particular embodiments, the connector conduits 324 and the housing 316 of the resonator 314 are sized to attenuate the high frequency sound energy. A second portion 326 of the housing 316 includes a plurality of apertures 328 formed therein to provide communication between the chambers 318 and the atmosphere. The apertures 328 are sized to minimize an amount of sound energy emanating from the resonator 314. It is understood, however, that the apertures 328 can also be sized and oriented to adjust at least one of a volume level, a direction, and a frequency of the sound energy emanating from the resonator 314.

The resonator 314 further includes a flexible member 330 disposed in each of the chambers 318. As shown in FIG. 4, an outer peripheral edge 332 of each of the flexible members 330 is crimped between the portions 322, 326 of the housing 316 to secure the flexible members 330 in the chambers 318. The apertures 328 formed in the housing 316 permit the flexible members 330 to vibrate in response to the acoustic pressure waves routed from the air conduit 312 to the chambers 318, and thereby attenuate the low frequency sound energy. It is understood that the flexible members 330 can be tuned to attenuate a desired frequency range. The flexible members 330 are formed from a material suitable for attenuating sound energy. Suitable materials may include, for example, at least one of a metal, an elastomer, a polymer, and a composite material. Illustratively, each of the flexible members 330 is a rubber or composite diaphragm, for example. A skilled artisan should appreciate that suitable materials and dimensions may be selected to attenuate the desired frequency. The suitable materials and dimensions may also provide a flexible member 330 that is substantially insensitive to temperature and humidity changes, which typically occur during vehicle operation. It should be understood that the flexible members 330 may be removable. Being removable, different flexible members 330 may be employed as desired to provide selective tuning of the resonator 314. Alternatively, the flexible members 330 may be permanently coupled to the housing 316, such as by securing the flexible members 330 to the wall 320 using an adhesive, for example.

The flexible members 330 shown lie in a plane transverse to a longitudinal axis of the connector conduits 324. Each of the flexible members 330 shown includes an outer portion 334 and an inner extension 335 protruding from the outer portion 334 inwardly into the housing 316 away from the connector conduits 324. The extension 335 shown is generally frusto-conical shaped having a generally planar portion 336 and an inwardly angled annular portion 338 extending between the outer portion 334 and the planar portion 336. The annular portion 338 structurally supports the planar portion 336 so that the flexible member 330 retains its shape. Retention of the shape of the flexible members 330 provides consistent attenuation of the sound energy at the desired frequency during operation of the vehicle. As shown, the planar portion 336 has a smaller diameter than a diameter of the outer portion 334. It is understood that the planar portion 336 may include at least one aperture (not shown) formed therein if desired. The outer portion 334 is supported by the housing 316 in such manner that a radially inner region 340 of the outer portion 334 and the extension 335 are capable of flexing in response to the acoustic pressure waves from the connector conduit 324. Although the outer portion 334 and the extension 335 of each of the flexible members 330 shown have a generally circular shape, it is understood that each of the outer portion 334 and the extension 335 can have any suitable shape as desired such as a square or rectangular shape, for example. It is further understood that the each of the flexible members 330 can have any suitable shape as desired.

Figure 5:
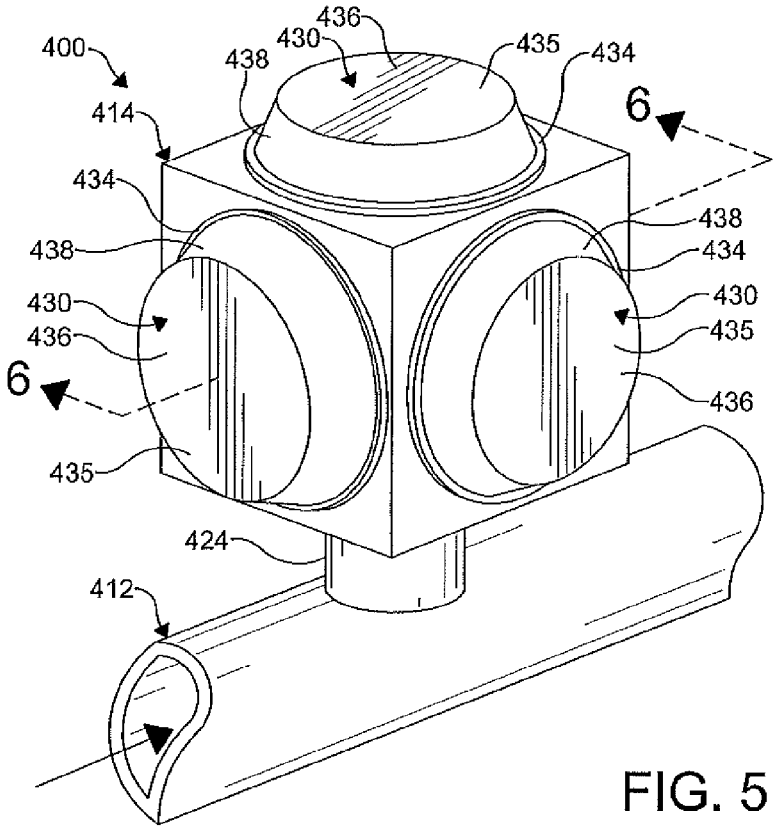
FIG. 5 is a side perspective view of a resonator including a housing having a chamber formed therein and a plurality of flexible members disposed therein according to another embodiment of the invention, wherein a portion of the housing is removed to show the flexible members.
Figure 6:
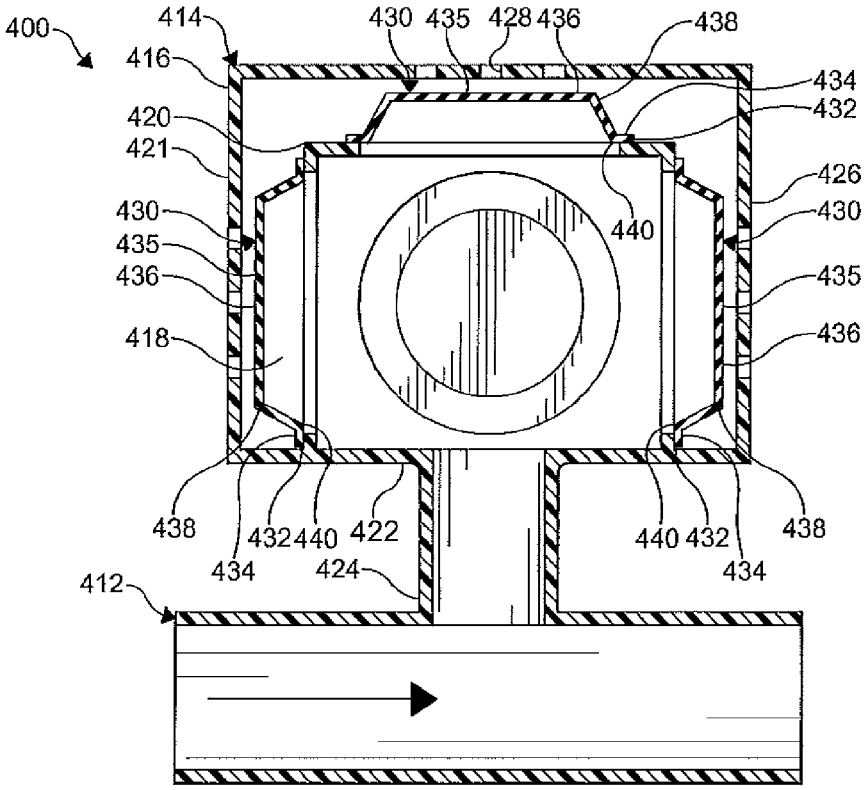
FIG. 6 is a cross-sectional elevational view of the resonator illustrated in FIG. 5.

FIGS. 5-6 show a portion of an air flow system 400 according to an embodiment of the present invention. The resonator 414 includes a housing 416 having a chamber 418 formed therein which is defined, at least in part, by an interior wall 420 and an exterior wall 421 of the housing 416. The housing 416 and the chamber 418 can have any suitable shape as desired such as a generally circular cross-sectional shape or a generally rectangular cross-sectional shape, for example. A skilled artisan should understand that the housing 416 may be formed from any suitable material as desired. For example, suitable materials may include at least one of a thermoplastic, a thermoset, a metal, and a composite material. In particular embodiments, the housing 416 may be formed by one of an injection molding and a blow molding process with a thermoplastic or a thermoset material. One of ordinary skill in the art should also appreciate that suitable dimensions of the chamber 418 may be selected, for example, to attenuate a desired amount of the acoustic pressure waves. In a non-limiting example, the chamber 418 has a volume less than 0.5 liters, and as small as 0.2 liters.

A first portion 422 of the housing 416 includes a connector conduit 424. The connector conduit 424 is coupled to the air conduit 412, and provides fluid communication between the air conduit 412 and the resonator 414. In an illustrative embodiment, the connector conduit 424 is of a lesser volume than a volume of the chamber 418 of the resonator 414. The connector conduit 424 may be adapted to control the acoustic pressure waves transmitted from the air conduit 412 to the chamber 418. A suitable connector conduit 424 size may be selected as desired. In particular embodiments, the connector conduit 424 and the housing 416 of the resonator 414 are sized to attenuate the high frequency sound energy. A second portion 426 of the housing 416, shown in FIG. 6, includes a plurality of apertures 428 formed therein to provide communication between the chamber 418 and the atmosphere. The apertures 428 are sized to minimize an amount of sound energy emanating from the resonator 414. It is understood, however, that the apertures 428 can also be sized and oriented to adjust at least one of a volume level, a direction, and a frequency of the sound energy emanating from the resonator 414.

The resonator 414 further includes a plurality of flexible members 430 disposed therein. As shown in FIG. 6, an outer peripheral edge 432 of each of the flexible members 430 is adhesively affixed to the interior wall 420 of the housing 416 to secure the flexible members 430 in the chamber 418. The apertures 428 formed in the housing 416 permit the flexible members 430 to vibrate in response to the acoustic pressure waves routed from the air conduit 412 to the chamber 418, and thereby attenuate the low frequency sound energy. It is understood that the flexible members 430 can be tuned to attenuate a desired frequency range. The flexible members 430 are formed from a material suitable for attenuating sound energy. Suitable materials may include, for example, at least one of a metal, an elastomer, a polymer, and a composite material. Illustratively, each of the flexible members 430 is a rubber or composite diaphragm, for example. A skilled artisan should appreciate that suitable materials and dimensions may be selected to attenuate the desired frequency. The suitable materials and dimensions may also provide a flexible member 430 that is substantially insensitive to temperature and humidity changes, which typically occur during vehicle operation. It should be understood that the flexible members 430 may be removable. For example, each of the flexible members 430 may be removably secured to the housing 416 by crimping the outer peripheral edge 432 thereof between the portions 422, 426 of the housing 416. Being removable, different flexible members 430 may be employed as desired to provide selective tuning of the resonator 414. Alternatively, the flexible members 430 may be permanently coupled to the housing 416.

Each of the flexible members 430 shown includes an outer portion 434 and an inner extension 435 protruding from the outer portion 434 inwardly into the housing 416 away from the connector conduit 424. The extension 435 shown is generally frusto-conical shaped having a generally planar portion 436 and an inwardly angled annular portion 438 extending between the outer portion 434 and the planar portion 436. The annular portion 438 structurally supports the planar portion 436 so that the flexible member 430 retains its shape. Retention of the shape of the flexible members 430 provides consistent attenuation of the sound energy at the desired frequency during operation of the vehicle. As shown, the planar portion 436 has a smaller diameter than a diameter of the outer portion 434. It is understood that the planar portion 436 may include at least one aperture (not shown) formed therein if desired. The outer portion 434 is supported by the housing 416 in such manner that a radially inner region 440 of the outer portion 434 and the extension 435 are capable of flexing in response to the acoustic pressure waves from the connector conduit 424. Although the outer portion 434 and the extension 435 of each of the flexible members 430 shown have a generally circular shape, it is understood that each of the outer portion 434 and the extension 435 can have any suitable shape as desired such as a square or rectangular shape, for example. It is further understood that each of the flexible members 430 can have any suitable shape as desired.

As should be appreciated, the resonator 14, 114, 214, 314, 414 of the present disclosure is particularly suitable for use in a motor vehicle having an internal combustion engine. The resonator 14, 114, 214, 314, 414 is readily configurable to meet various tuning requirements, for example, by selecting the housing 16, 116, 216, 316, 416 and the panels 30, 130, 230, 330, 430 having the desired tunable parameters, or interchanging the panels 30, 130, 230, 330, 430 in the housing 16, 116, 216, 316, 416 as desired.

From the foregoing description, one ordinarily skilled in the art can easily ascertain the essential characteristics of this invention and, without departing from the spirit and scope thereof, can make various changes and modifications to the invention to adapt it to various usages and conditions.

What is claimed is:

1. A resonator for a vehicle, comprising:

a housing including at least one chamber formed therein, wherein the housing is coupled to and in fluid communication with an air conduit; and at least one flexible member disposed within the at least one chamber configured to attenuate sound energy, wherein the at least one flexible member divides the at least one chamber into a first sub-chamber and a second sub-chamber, and wherein the at least one flexible member includes an outer portion having an extension protruding therefrom into the second sub-chamber of the housing away from the air conduit, wherein a portion of the housing defining the second sub-chamber includes at least one aperture formed therein to permit fluid communication between the second sub-chamber and a surrounding atmosphere.

2. The resonator of claim 1, wherein the housing has a volume of less than about 0.5 liters.

3. The resonator of claim 1, further comprising an interior wall configured to define an inner chamber and an outer chamber.

4. The resonator of claim 3, wherein the interior wall includes at least one aperture formed therein to provide fluid communication between the inner chamber and the outer chamber.

5. The resonator of claim 1, wherein the flexible member is tunable to attenuate sound energy having a frequency of less than about 250 hertz.

6. The resonator of claim 1, further comprising at least one connector conduit disposed between the housing and the air conduit to provide fluid communication therebetween.

7. The resonator of claim 6, wherein the at least one connector conduit and the housing are tunable to attenuate sound energy having a frequency greater than about 250 hertz.

8. The resonator of claim 1, wherein the outer portion has a generally disc shape.

9. The resonator of claim 1, wherein the extension has a generally frusto-conical shape.

10. A resonator for a vehicle, comprising:

a housing including a plurality of chambers and at least one aperture formed therein, wherein each of the chambers is in direct fluid communication with an atmosphere through the at least one aperture, and wherein the housing is coupled to and in fluid communication with an air conduit through at least one connector conduit; and a plurality of flexible members, each of the flexible members disposed within one of the chambers configured to attenuate sound energy, wherein each of the flexible members includes an outer portion having an extension protruding therefrom into the housing away from the air conduit.

11. The resonator of claim 10, wherein the housing has a volume of less than about 0.5 liters.

12. The resonator of claim 10, wherein the flexible member is tunable to attenuate sound energy having a frequency of less than about 250 hertz.

13. The resonator of claim 10, wherein the at least one connector conduit and the housing are tunable to attenuate sound energy having a frequency greater than about 250 hertz.

14. The resonator of claim 10, wherein the extension of the flexible member includes a substantially planar portion and an inwardly angled portion extending between the outer portion and the planar portion.

15. A resonator for a vehicle, comprising:

a housing including a chamber and at least one aperture formed therein, wherein the chamber is in direct fluid communication with an atmosphere through the at least one aperture, and wherein the housing is coupled to and in fluid communication with an air conduit through at least one connector conduit; and a plurality of flexible members disposed within the chamber configured to attenuate sound energy, wherein each of the flexible members includes an outer portion having an extension protruding therefrom into the housing away from the air conduit.

16. The resonator of claim 15, wherein the housing has a volume of less than about 0.5 liters.

17. The resonator of claim 15, wherein the flexible member is tunable to attenuate sound energy having a frequency of less than about 250 hertz.

18. The resonator of claim 15, wherein the at least one connector conduit and the housing are tunable to attenuate sound energy having a frequency greater than about 250 hertz.

19. The resonator of claim 15, wherein the extension of the flexible member includes a substantially planar portion and an inwardly angled portion extending between the outer portion and the planar portion.

* * * * *